US011326771B2

(12) United States Patent
Xu et al.

(10) Patent No.: US 11,326,771 B2
(45) Date of Patent: May 10, 2022

(54) LIGHT-EMITTING FAN

(71) Applicant: VAST GLORY ELECTRONICS & HARDWARE & PLASTIC(HUI ZHOU) LTD., Hui Zhou (CN)

(72) Inventors: Shi-Man Xu, Hui Zhou (CN); Qiancheng Yue, Hui Zhou (CN)

(73) Assignee: VAST GLORY ELECTRONICS & HARDWARE & PLASTIC (HUI ZHOU) LTD., Hui Zhou (CN)

( * ) Notice: Subject to any disclaimer, the term of this patent is extended or adjusted under 35 U.S.C. 154(b) by 42 days.

(21) Appl. No.: 16/846,094

(22) Filed: Apr. 10, 2020

(65) Prior Publication Data

US 2021/0222868 A1 Jul. 22, 2021

(30) Foreign Application Priority Data

Jan. 21, 2020 (CN) ..... 202010070162.8
Jan. 31, 2020 (TW) ..... 109103052

(51) Int. Cl.

| | |
|---|---|
| ***F21V 33/00*** | (2006.01) |
| ***F04D 29/00*** | (2006.01) |
| ***F21V 19/00*** | (2006.01) |
| ***F04D 19/00*** | (2006.01) |
| ***F21Y 105/18*** | (2016.01) |
| ***F21Y 115/10*** | (2016.01) |
| ***F21Y 103/33*** | (2016.01) |

(52) U.S. Cl.

CPC ..... *F21V 33/0096* (2013.01); *F04D 29/005* (2013.01); *F04D 19/002* (2013.01); *F21V 19/003* (2013.01); *F21Y 2103/33* (2016.08); *F21Y 2105/18* (2016.08); *F21Y 2115/10* (2016.08)

(58) Field of Classification Search

CPC .. F21V 33/0096; F21V 19/003; F04D 29/005; F04D 19/002; F21Y 2105/18; F21Y 2103/33; F21Y 2115/10

See application file for complete search history.

(56) References Cited

U.S. PATENT DOCUMENTS

| | | | | |
|---|---|---|---|---|
| 9,777,918 | B1 * | 10/2017 | Wen | F21V 17/06 |
| 2019/0249862 | A1 * | 8/2019 | Fan | H05K 7/20172 |
| 2021/0207796 | A1 * | 7/2021 | Fan | F21V 7/0091 |

* cited by examiner

*Primary Examiner* — Joseph L Williams
*Assistant Examiner* — Jose M Diaz
(74) *Attorney, Agent, or Firm* — Maschoff Brennan

(57) ABSTRACT

This disclosure relates to a light-emitting fan includes a fan frame, an impeller, and a light-emitting component. The fan frame includes a base, a first ring, and a second ring. The first ring is disposed on the base. The second ring is disposed on the first ring. The first ring is located between the base and the second ring, and the first ring and the second ring together form an accommodating space. The impeller is located in the accommodating space and rotatably disposed on the base. The light-emitting component is located in the first ring or the second ring. One of the first ring and the second ring is made of light-permeable plastic, the other one is made of light-impermeable plastic, and light from the light-emitting component is emitted through the first or second ring.

15 Claims, 9 Drawing Sheets

LIGHT-EMITTING FAN

CROSS-REFERENCE TO RELATED APPLICATIONS

This non-provisional application claims priority under 35 U.S.C. § 119(a) on Patent Application No(s). 202010070162.8 filed in China, P.R.C. on Jan. 21, 2020 and Patent Application No(s). 109103052 filed in Taiwan, R.O.C on Jan. 31, 2020, the entire contents of which are hereby incorporated by reference.

TECHNICAL FIELD

The present disclosure relates to a fan, more particularly to a light-emitting fan.

BACKGROUND

As technology continues to advance, products continue to improve in functionality to meet the high demand of customers.

It is known that the same type of products may possess similar functionality so that merely improving the functionality or practicality may be still insufficient to compete in a highly competitive market. Therefore, in order to make the products more appealing than other similar products on the market, some try to improve aesthetic design.

Taking fans as an example, in the current market, more and more fans incorporate with light-emitting devices (e.g., light-emitting diodes (LEDs)). One or more LEDs and associated control circuits may be arranged on the fan so as to transform the conventional fan into one having light-emitting effects.

The light-emitting direction of the fan may be different to adapt the actual applications. However, conventionally, the fans of different light-emitting directions must be produced using respective molds due to the restrictions of injection molding technique. As such, making light-emitting fans of different lighting effects increases the mold cost. Therefore, how to make one mold manufacture light-emitting fans of different light-emitting effects become a problem to be solved.

SUMMARY

The present disclosure provides a light-emitting fan having a configuration that can be made having different light-emitting effects by one specific mold so as to reduce the mold development cost for making light-emitting fans of different lighting effects.

According to one aspect of the present disclosure, a light-emitting fan includes a fan frame, an impeller, and a light-emitting component. The fan frame includes a base, a first ring, and a second ring. The first mounting ring is disposed on the base. the second ring is disposed on the first ring. The first ring is located between the base and the second ring, and the first ring and the second ring together form an accommodating space. The impeller is located in the accommodating space and rotatably disposed on the base. The light-emitting component is located in the first ring or the second ring. One of the first ring and the second ring is made of light-permeable plastic, the other one of the first ring and the second ring is made of light-impermeable plastic, and light from the light-emitting component is emitted through the first ring or the second ring.

According to another aspect of the present disclosure, a light-emitting fan includes a fan frame, an impeller, and a light-emitting component. The fan frame includes a base, a first ring, and a second ring. The first ring is disposed on the base. The second ring is disposed on the first ring. The first ring is located between the base and the second ring, and the first ring and the second ring together form an accommodating space. The impeller is located in the accommodating space and rotatably disposed on the base. The light-emitting component is located in the first ring or the second ring. The first ring and the second ring are made of plastics having different tranmittances.

According to the light-emitting fan discussed above, the fan frame is assembled from the base, the second ring, and the first ring located between the base and the second ring, and these three pieces can be produced using the same mold. Therefore, respectively using different plastic materials for making the first ring and the second ring can produce various light-emitting fans having different lighting effects. In other words, due to the configuration of the light-emitting fan, one specific mold can be used to make various light-emitting fans having different lighting effects. Accordingly, the mold development cost for making light-emitting fans of different lighting effects is reduced.

BRIEF DESCRIPTION OF THE DRAWINGS

The present disclosure will become more fully understood from the detailed description given hereinbelow and the accompanying drawings which are given by way of illustration only and thus are not intending to limit the present disclosure and wherein.

DETAILED DESCRIPTION

Figure 1:
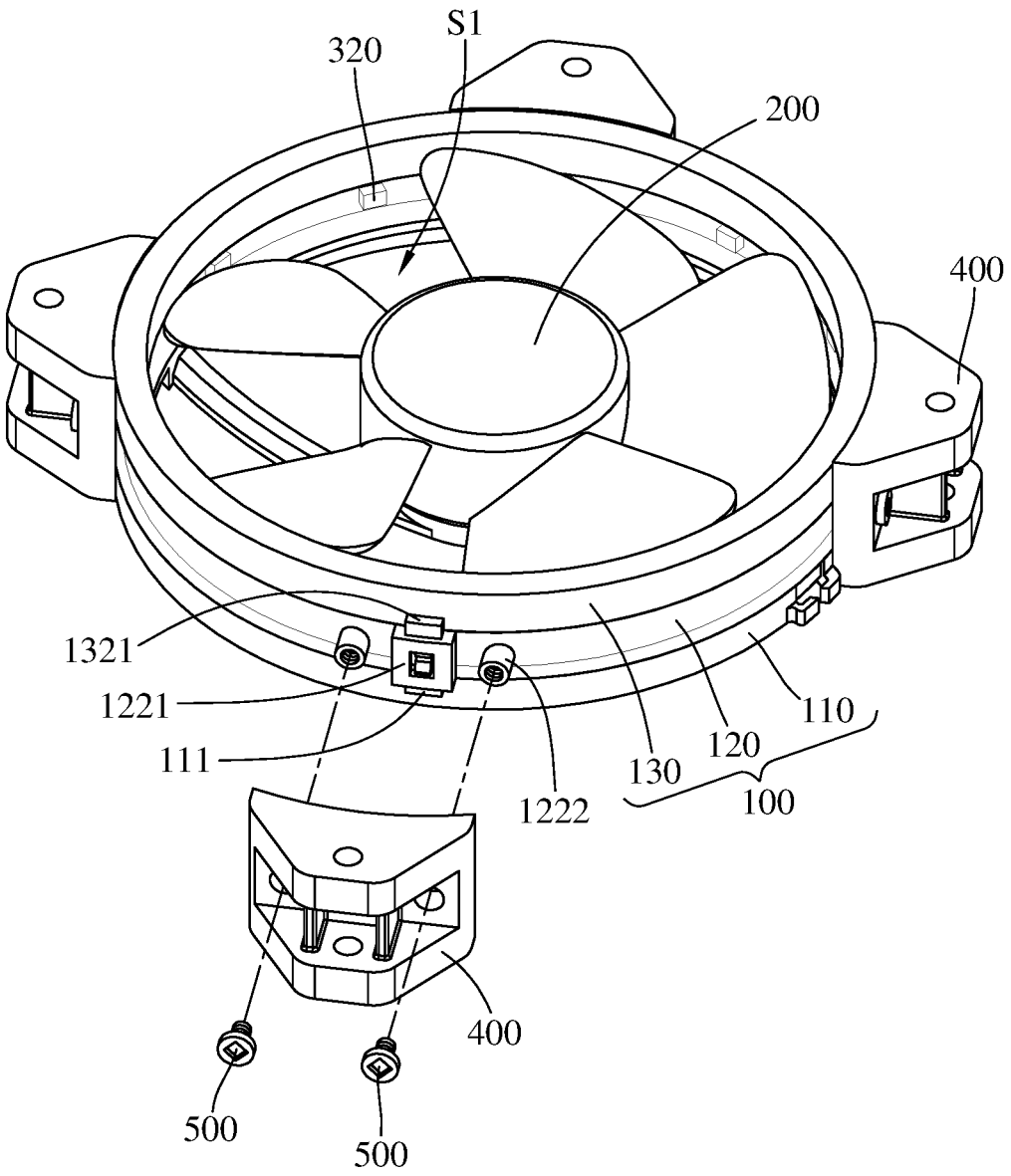
FIG. 1 depicts a perspective view of a light-emitting fan according to the first embodiment of the present disclosure.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

In the present disclosure, a light-emitting fan includes, for example, a fan frame, an impeller, and a light-emitting component. The fan frame includes a base, a first ring, and a second ring. The first ring is disposed on the base. The second ring is disposed on the first ring. The first ring is located between the base and the second ring, and the first ring and the second ring together form an accommodating space. The impeller is located in the accommodating space and rotatably disposed on the base. The light-emitting component is located in the first ring or the second ring. One of the first ring and the second ring is made of light-permeable plastic, the other one of the first ring and the second ring is made of light-impermeable plastic, and light from the light-emitting component is emitted through the first ring or the second ring. The base, the first ring, and the second ring can be produced using the same mold. Therefore, respectively using different plastic materials for making the first ring and the second ring can produce various light-emitting fans having different lighting effects. In other words, due to the configuration of the light-emitting fan, one specific mold can be used to make various light-emitting fans having different lighting effects. Accordingly, the mold development cost for making light-emitting fans of different lighting effects is reduced.

Figure 2:
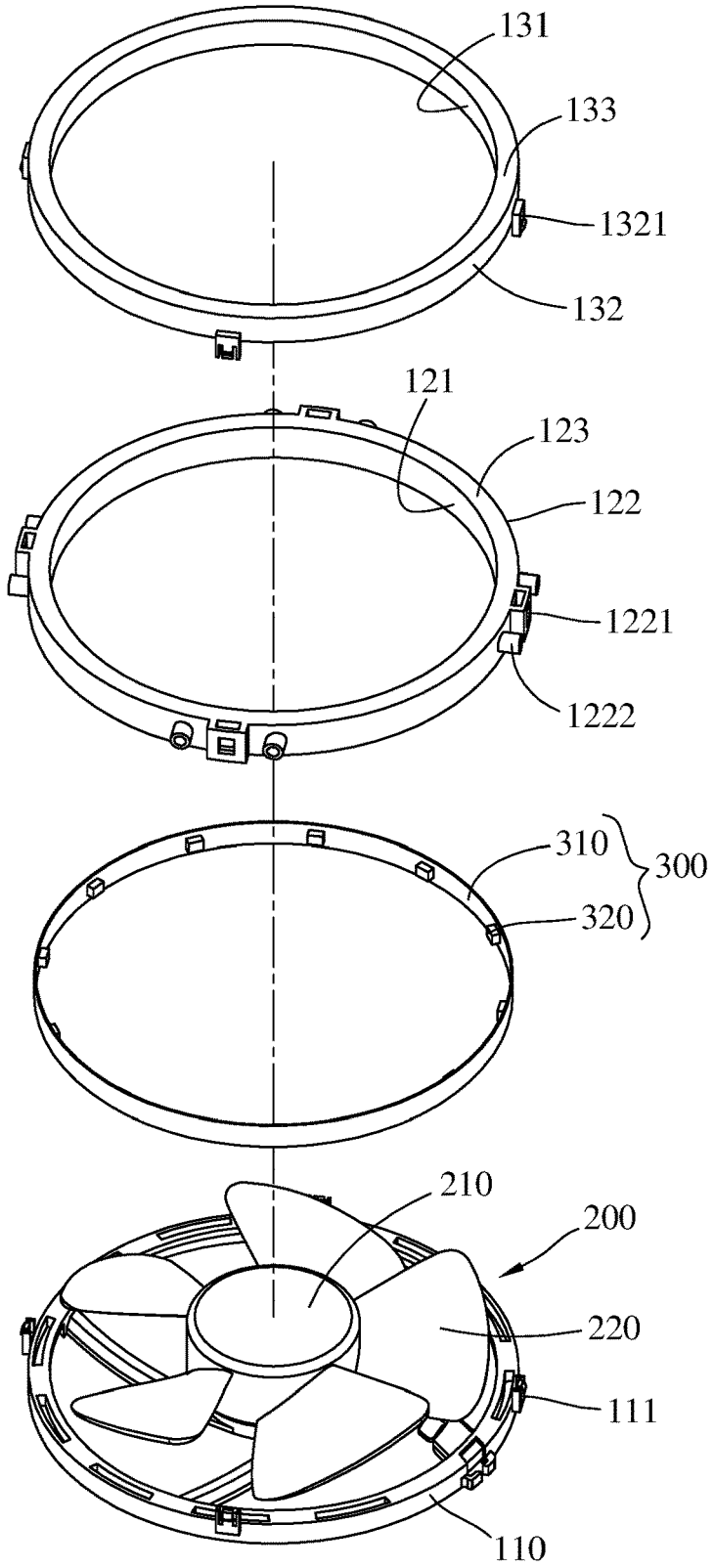
FIG. 2 is an exploded view of the light-emitting fan in FIG. 1.
Figure 3:
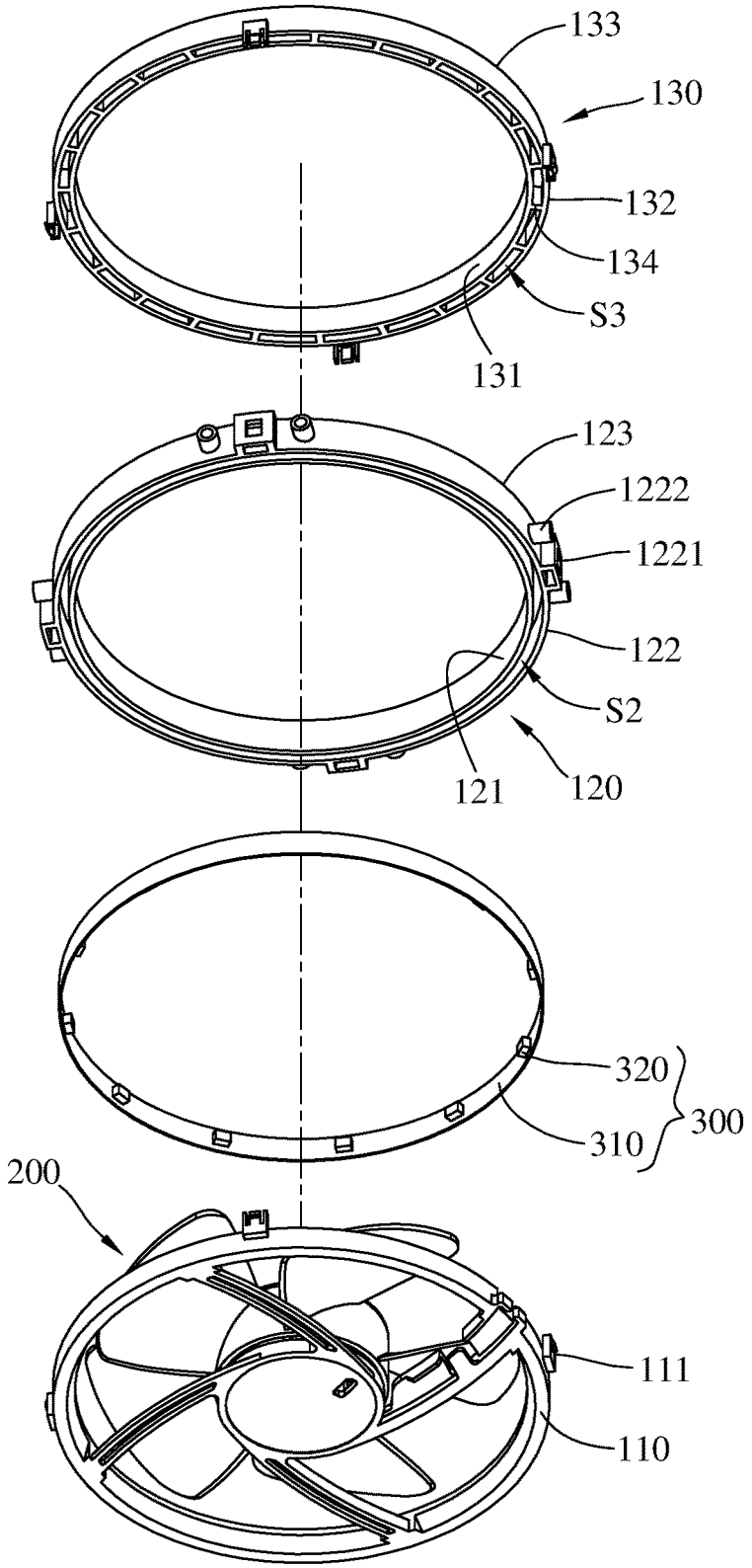
FIG. 3 is another exploded view of the light-emitting fan in FIG. 1.
Figure 4:
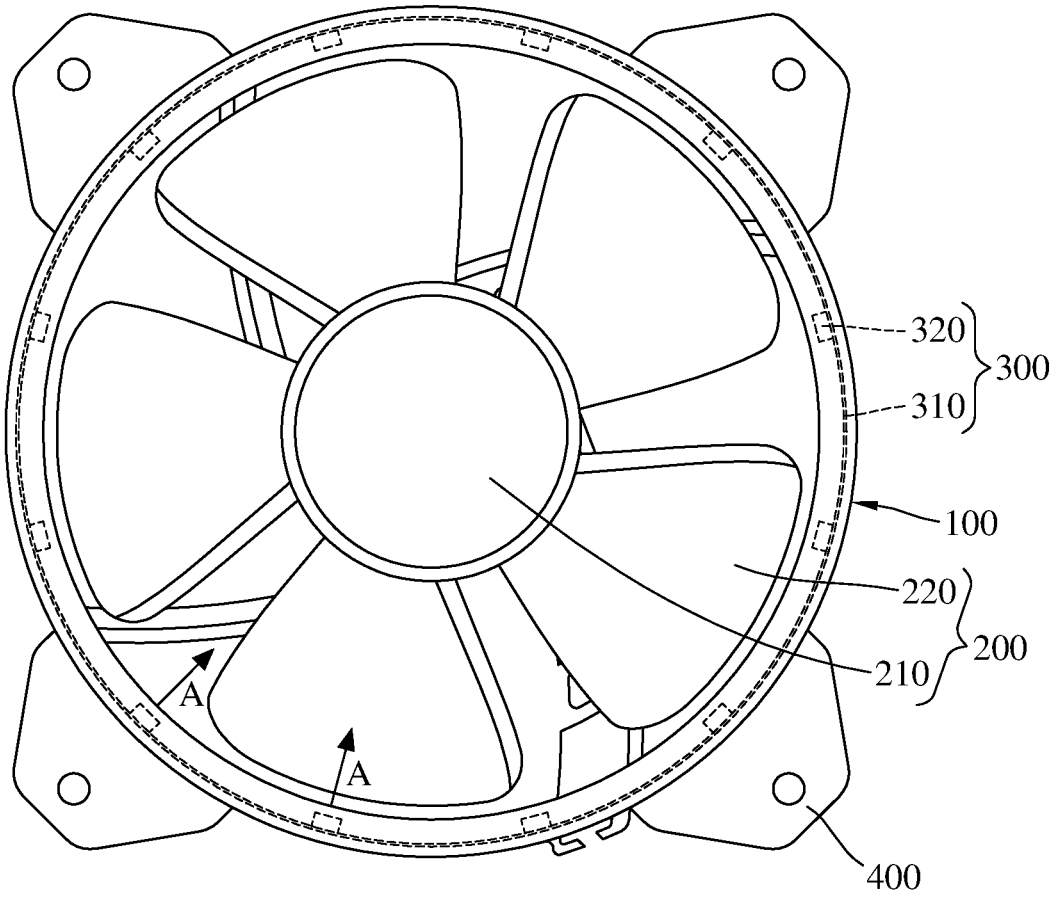
FIG. 4 is a top view of the light-emitting fan in FIG. 1.
Figure 5:
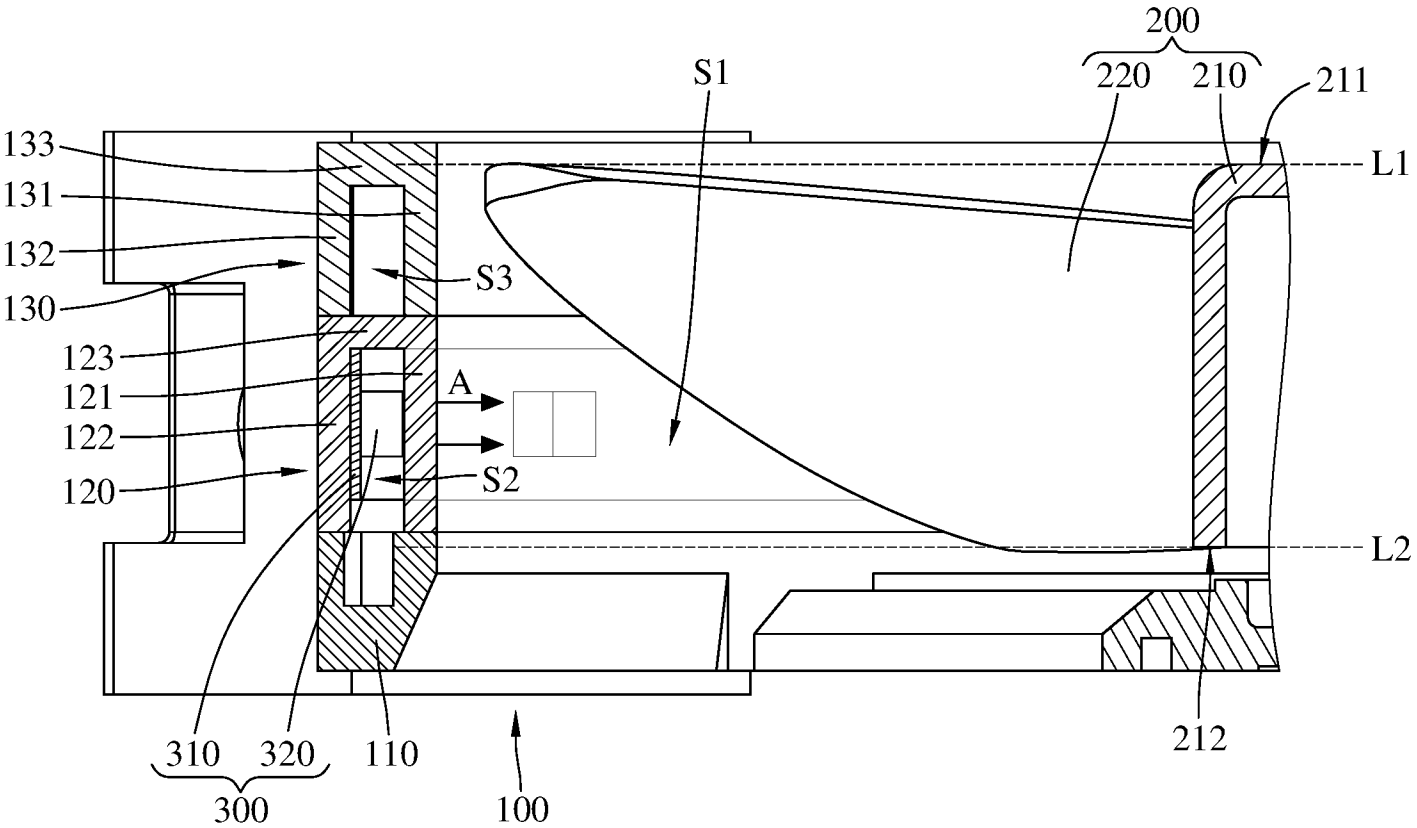
FIG. 5 is a partially enlarged view of the sectioned light-emitting fan in FIG. 1.

An exemplary light-emitting fan of the disclosure having light-emitting impeller and fan frame on inner side thereof is described hereinafter. Referring to FIGS. 1-5, where FIG. 1 depicts a perspective view of a light-emitting fan 10 according to a first embodiment of the present disclosure, FIG. 2 is an exploded view of the light-emitting fan 10 in FIG. 1, FIG. 3 is another exploded view of the light-emitting fan 10 in FIG. 1, FIG. 4 is a top view of the light-emitting fan 10 in FIG. 1, and FIG. 5 is a partially enlarged view of the sectioned light-emitting fan 10 in FIG. 1.

In this embodiment, the light-emitting fan 10 includes, for example, a fan frame 100, an impeller 200, and a light-emitting component 300.

Specifically, the fan frame 100 includes a base 110, a first ring 120, and a second ring 130.

The base 110 is made by, for example, plastic injection molding process, and the material of the base 110 may include light-impermeable plastic (e.g., polybutylene terephthalate (PBT), polycarbonate (PC), acrylonitrile butadiene styrene (ABS)). In other words, the base 110 is made of light-impermeable plastic by injection molding process. However, the material of the base 110 is not restricted to be light-impermeable; in some embodiments, the base 110 may be made of light-permeable plastic by injection molding process.

The first ring 120 is made by, for example, plastic injection molding process; and the material of the first ring 120 may include light-permeable plastic (e.g., transparent/matte milky white polycarbonate (PC)). In other words, the first ring 120 is made of light-permeable plastic by injection molding process. In more detail, the first ring 120 includes a first inner part 121, a first outer part 122, and a first connection part 123. The first inner part 121 and the first outer part 122 form a first annular groove S2 therebetween. The first connection part 123 is connected to the first inner part 121 and the first outer part 122 and covers a side of the first annular groove S2. The first inner part 121 and the first outer part 122 are disposed on the base 110.

The second ring 130 is made by, for example, plastic injection molding process, and the material of the second ring 130 may include light-impermeable plastic (e.g., polybutylene terephthalate (PBT), polycarbonate (PC), acrylonitrile butadiene styrene (ABS)). In other words, the second ring 130 is made of light-impermeable plastic by injection molding process. In more detail, the second ring 130 includes a second inner part 131, a second outer part 132, a second connection part 133, and a plurality of reinforcing ribs 134. The second inner part 131 and the second outer part 132 form a second annular groove S3 therebetween. The second connection part 133 is connected to the second inner part 131 and the second outer part 132 and covers a side of the second annular groove S3. The reinforcing ribs 134 are located in the second annular groove S3 and disposed on the first connection part 123.

In this embodiment, the base 110 includes a plurality of first engagement components 111. The first outer part 122 of the first ring 120 includes a plurality of second engagement components 1221. The second outer part 132 of the second ring 130 includes a plurality of third engagement components 1321. The first engagement components 111 are respectively detachably engaged with the second engagement components 1221, the third engagement components 1321 are respectively detachably engaged with the second engagement components 1221, and the first engagement components 111 and the third engagement components 1321 are located at different sides of the second engagement components 1221. In this embodiment, the engagements of the base 110, the first ring 120, and the second ring 130 are not intend to limit the present disclosure. In some embodiments, the base, the first ring, and the second ring may be connected via screws or adhesive.

The impeller 200 is located in an accommodating space S1 formed by the first ring 120 and the second ring 130. The impeller 200 includes a hub 210 and a plurality of blades 220. The hub 210 is rotatably disposed on the base 110. The blades 220 are connected to the hub 210. The blades 220 are configured to generate air flow when the impeller 200 rotates relatively to the base 110.

The light-emitting component 300 includes a ring-shaped substrate 310 and a plurality of light sources 320. The ring-shaped substrate 310 is located in the first annular groove S2. The light sources 320 are, for example, light-emitting diodes (LEDs) and are disposed on a side of the ring-shaped substrate 310 facing the first inner part 121 of the first ring 120 so as to emit light towards the first inner part 121 (as the direction A shown in FIG. 4 and FIG. 5). In addition, in this embodiment, the ring-shaped substrate 310 is configured to block light from emitting towards the first outer part 122.

In addition, the hub 210 has a top surface 211 and a bottom surface 212 opposite to each other. The bottom surface 212 is located closer to the base 110 than the top surface 211. The first ring 120 is located between a plane L1 where the top surface 211 is located and a plane L2 where the bottom surface 212 is located. As such, light generated by the light sources 320 can be evenly emitted towards the impeller 200 so that the impeller 200 can emit uniform and therefore gives aesthetically pleasing effects.

In this embodiment, the light-emitting fan 10 further includes a plurality of cushions 400 and a plurality of fasteners 500, and the first ring 120 further includes a plurality of protrusions 1222 connected to different sides of the first outer part 122. The cushions 400 are disposed to the protrusions 1222 via the fasteners 500 configured to be engaged with the protrusions 1222. In addition, the cushions 400 cover the first engagement components 111, the second engagement components 221, and the third engagement components 1321 to make the light-emitting fan 10 more aesthetically pleasing.

Figure 6:
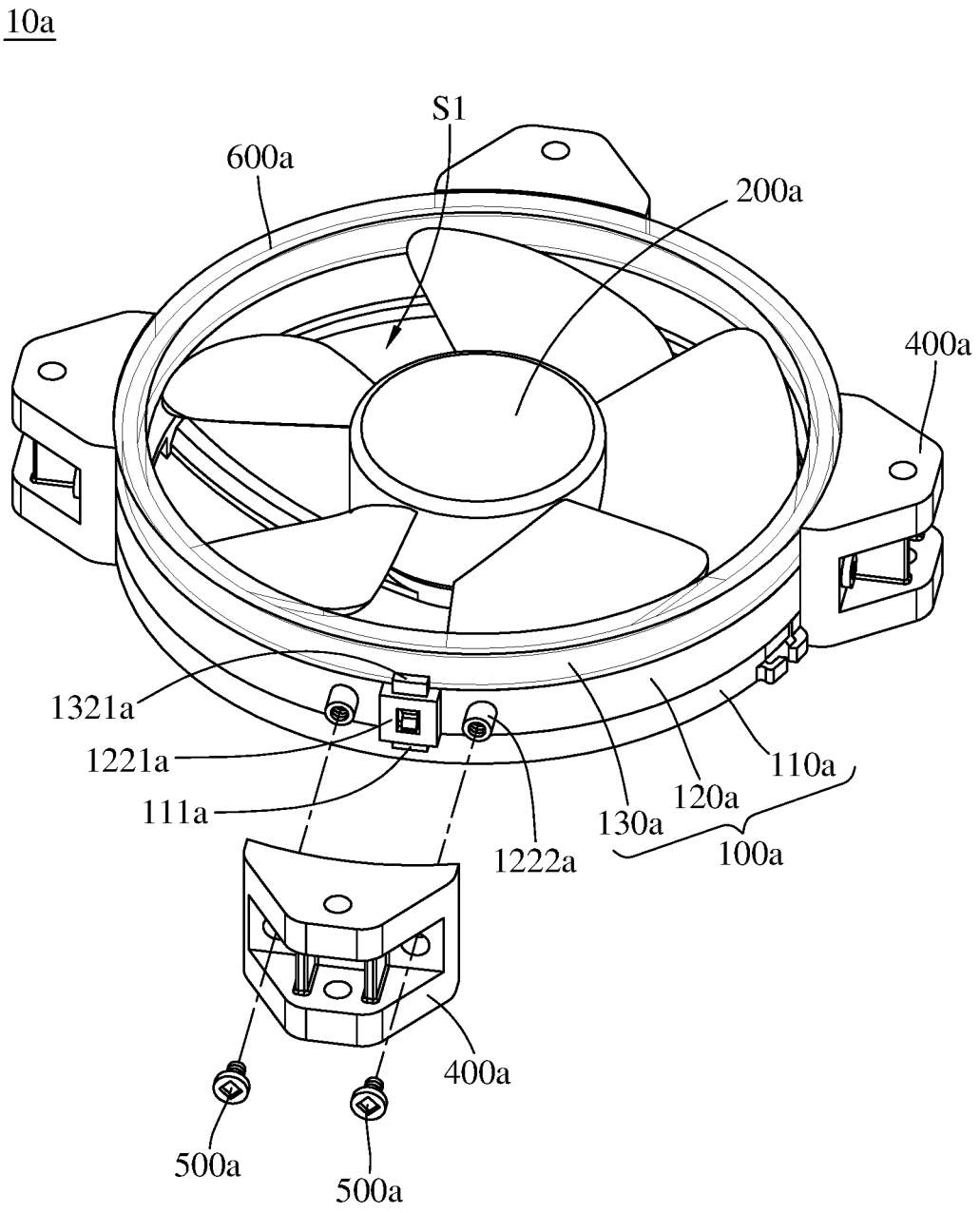
FIG. 6 depicts a perspective view of a light-emitting fan according to the second embodiment of the present disclosure.
Figure 7:
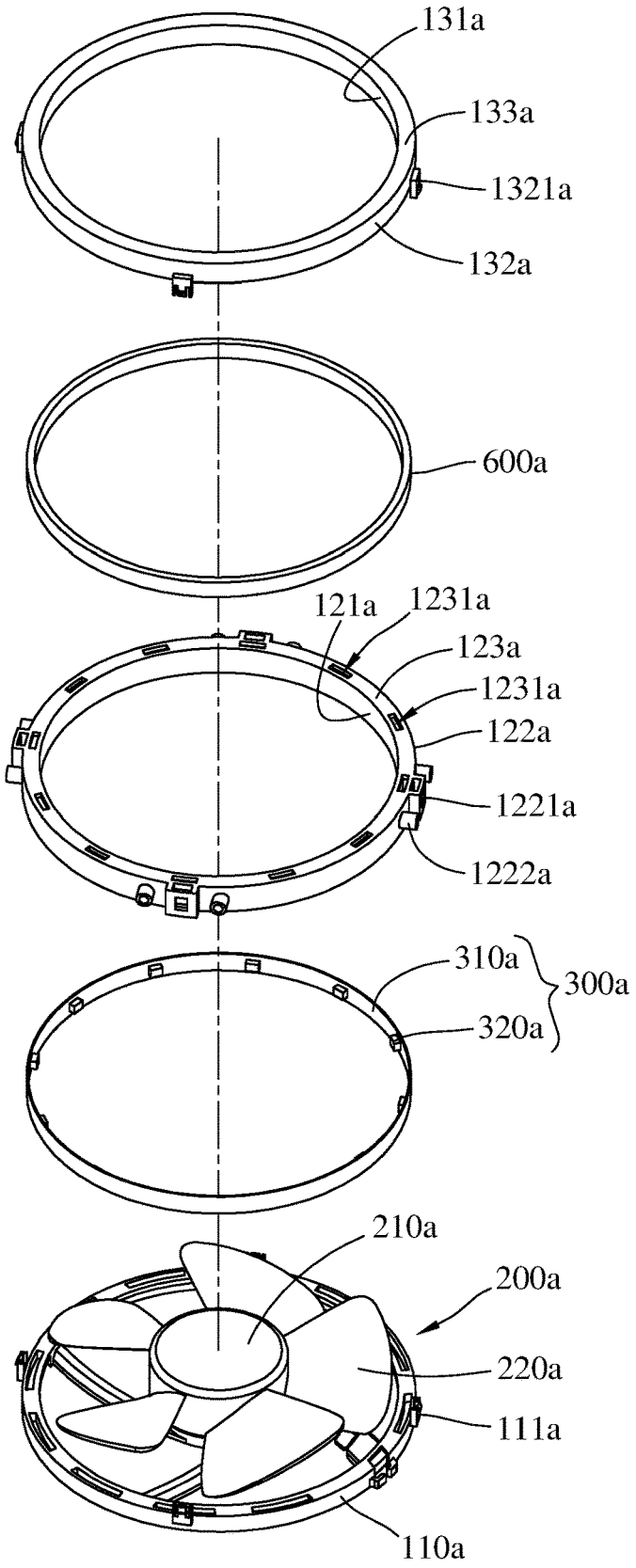
FIG. 7 is an exploded view of the light-emitting fan in FIG. 6.
Figure 8:
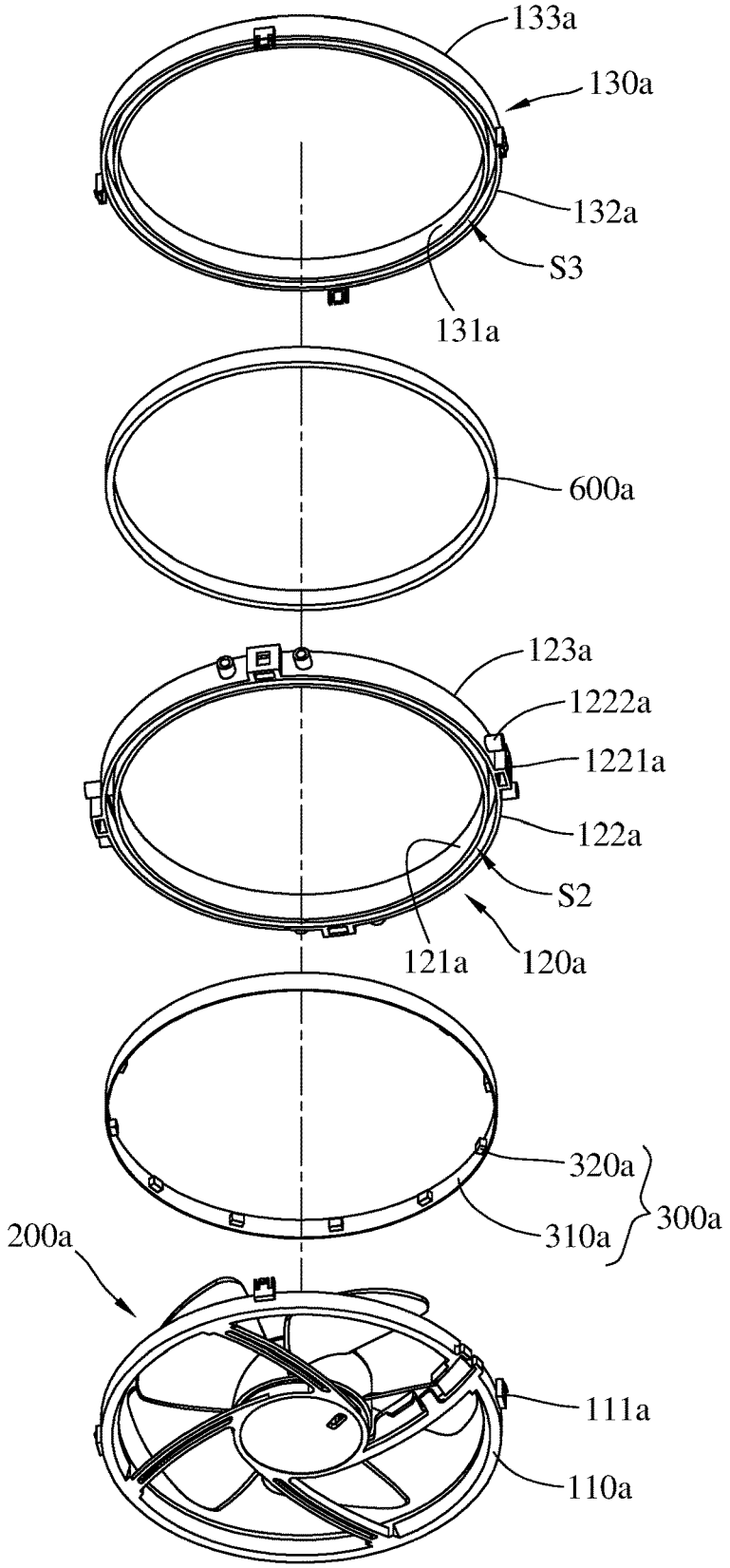
FIG. 8 is another exploded view of the light-emitting fan in FIG. 6.
Figure 9:
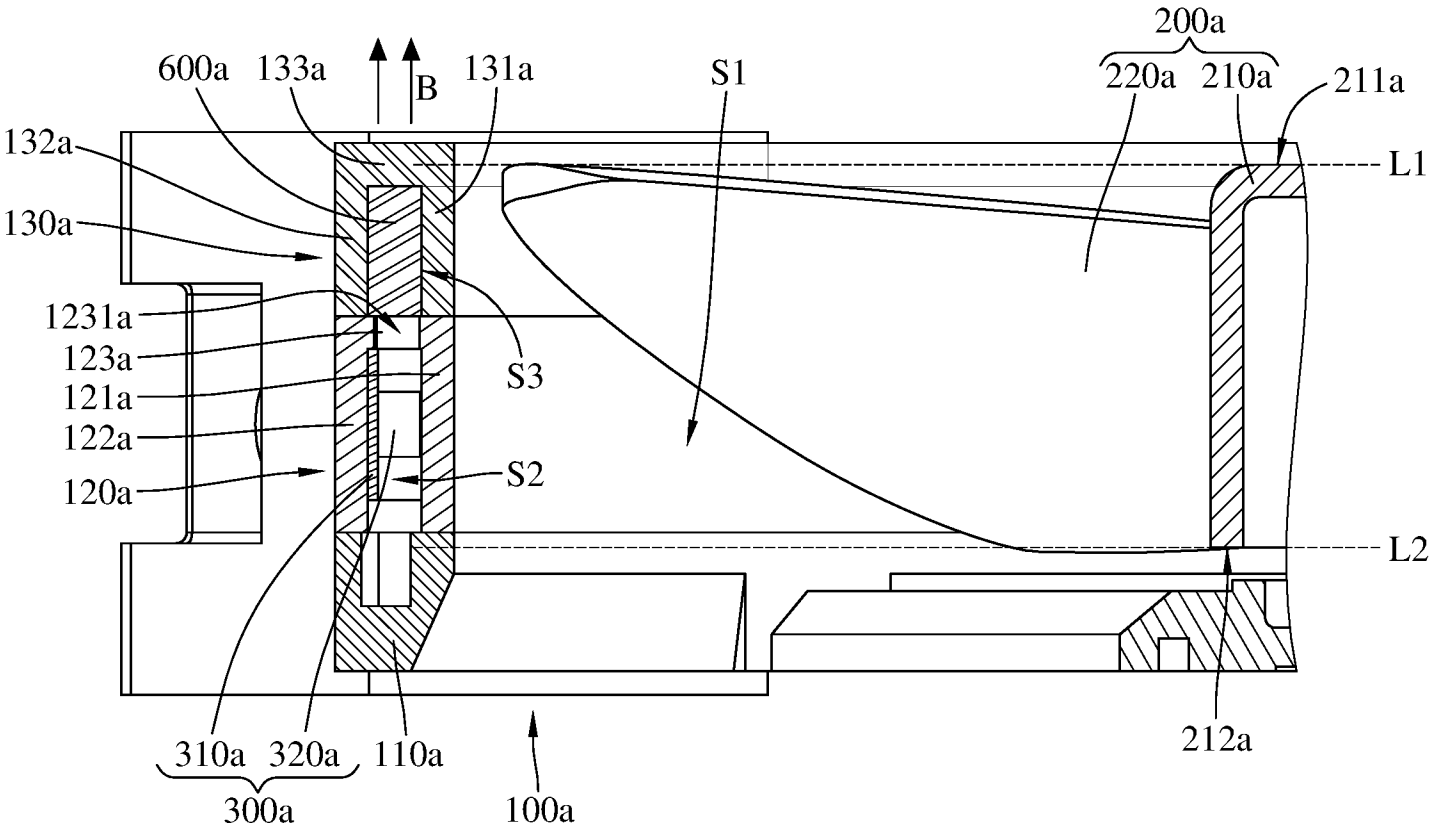
FIG. 9 is a partially enlarged view of the sectioned light-emitting fan in FIG.6.

An exemplary light-emitting fan of the disclosure having light-emitting fan frame on top side thereof is described hereinafter. Referring to FIGS. 6-9, where FIG. 6 depicts a perspective view of a light-emitting fan 10*a* according to a second embodiment of the present disclosure, FIG. 7 is an exploded view of the light-emitting fan 10*a* in FIG. 6, FIG. 8 is another exploded view of the light-emitting fan 10*a* in FIG. 6, and FIG. 9 is a partially enlarged view of the sectioned light-emitting fan 10*a* in FIG.6.

In this embodiment, the light-emitting fan 10*a* includes, for example, a fan frame 100*a*, an impeller 200*a*, and a light-emitting component 300*a*.

Specifically, the fan frame 100*a* includes a base 110*a*, a first ring 120*a*, and a second ring 130*a*.

The base 110*a* is made by, for example, plastic injection molding process, and the material of the base 110*a* may include light-impermeable plastic (e.g., polybutylene terephthalate (PBT), polycarbonate (PC), acrylonitrile butadiene styrene (ABS)). In other words, the base 110*a* is made of light-impermeable plastic by injection molding process. However, the material of the base 110*a* is not restricted to be light-impermeable; in some embodiments, the base 110*a* may be made of light-permeable plastic by injection molding process.

The first ring 120*a* is made by, for example, plastic injection molding process and the material of the first ring 120*a* may include light-impermeable plastic (e.g., polybutylene terephthalate (PBT), polycarbonate (PC), acrylonitrile butadiene styrene (ABS)). In other words, the first ring 120*a* is made of light-impermeable plastic by injection molding process. In more detail, the first ring 120*a* includes a first inner part 121*a*, a first outer part 122*a*, and a first connection part 123*a*. The first inner part 121*a* and the first outer part 122*a* form a first annular groove S2 therebetween. The first connection part 123*a* is connected to the first inner part 121*a* and the first outer part 122*a* and covers a side of the first annular groove S2. The first connection part 123*a* has a plurality of holes 1231*a*. The first inner part 121*a* and the first outer part 122*a* are disposed on the base 110*a*.

The second ring 130*a* is made by, for example, injection molding process, and the material of the second ring 130*a* may include light-permeable plastic (e.g., transparent/matte milky white polycarbonate (PC)). In other words, the second ring 130*a* is made of light-permeable plastic by injection molding process. In more detail, the second ring 130*a* includes a second inner part 131*a*, a second outer part 132*a*, and a second connection part 133*a*. The second inner part 131*a* and the second outer part 132*a* form a second annular groove S3 therebetween. The second connection part 133*a* is connected to the second inner part 131*a* and the second outer part 132*a* and covers a side of the second annular groove S3. The second inner part 131*a* and the second outer part 132*a* are disposed on the first connection part 123*a*, and the second annular groove S3 and the first annular groove S2 are connected via the holes 1231*a*.

In this embodiment, the base 110*a* includes a plurality of first engagement components 111*a*. The first outer part 122*a* of the first ring 120*a* includes a plurality of second engagement components 1221*a*. The second outer part 132*a* of the second ring 130*a* includes a plurality of third engagement components 1321*a*. The first engagement components 111*a* are respectively detachably engaged with the second engagement components 1221*a*, the third engagement components 1321*a* are respectively detachably engaged with the second engagement components 1221*a*, and the first engagement components 111*a* and the third engagement components 1321*a* are located at different sides of the second engagement components 1221*a*. In this embodiment, the engagements of the base 110*a*, the first ring 120*a*, and the second ring 130*a* are not intend to limit the present disclosure. In some embodiments, the base, the first ring, and the second ring may be connected via screws or adhesive.

The impeller 200*a* is located in an accommodating space S1 formed by the first ring 120*a* and the second ring 130*a*. The impeller 200*a* includes a hub 210*a* and a plurality of blades 220*a*. The hub 210*a* is rotatably disposed on the base 110*a*. The blades 220*a* are connected to the hub 210*a*. The blades 220*a* are configured to generate air flow when the impeller 200*a* rotates relatively to the base 110*a*.

The light-emitting component 300*a* includes a ring-shaped substrate 310*a* and a plurality of light sources 320*a*. The ring-shaped substrate 310*a* is located in the first annular groove S2. The light sources 320*a* are, for example, light-emitting diodes (LEDs) and are disposed on a side of the ring-shaped substrate 310*a* facing the first inner part 121*a* of the first ring 120*a*. In addition, in this embodiment, the light-emitting fan 10*a* further includes a light guide 600*a*. The light guide 600*a* is in a ring-shape and located in the second annular groove S3 so as to guide light generated by the light-emitting component 300*a* towards the second connection part 133*a* of the second ring 130*a* (as the direction B shown in FIG. 9).

However, in this embodiment, the shape and quantity of the ring-shaped light guide 600*a* is not intending to limit the present disclosure. In some embodiments, the second annular groove may accommodate a plate-shaped light guide which is at one side of the impeller; or, the second annular groove may accommodate plural plate-shaped light guides which are at different sides of the impeller; or, there may be no light guide in the second annular groove, and the light generated by the light-emitting component may reach the second inner part, the second outer part, and the second connection part of the second ring through air.

In addition, in this embodiment, the hub 210*a* has a top surface 211*a* and a bottom surface 212*a* opposite to each other. The bottom surface 212*a* is located closer to the base 110*a* than the top surface 211*a*. The first ring 120*a* and part of the second ring 130*a* are located between a plane L1 where the top surface 211*a* is located and a plane L2 where the bottom surface 212*a* is located, but the present disclosure is not limited thereto. In some embodiment, the second ring may be wholly located at a side of the plane, where the top surface is located, away from the base so as to prevent light emitting towards the impeller from the second inner part.

In this embodiment, the light-emitting fan 10*a* further includes a plurality of cushions 400*a* and a plurality of fasteners 500*a*, and the first ring 120*a* further includes a plurality of protrusions 1222*a* connected to different sides of the first outer part 122*a*. The cushions 400*a* are disposed to the protrusions 1222*a* via the fasteners 500*a* configured to be engaged with the protrusions 1222*a*. In addition, the cushions 400*a* cover the first engagement components 111*a*, the second engagement components 221*a*, and the third engagement components 1321*a* to make the light-emitting fan 10*a* more aesthetically pleasing.

According to the abovementioned embodiments, the fan frame is assembled from the base, the second ring, and the first ring located between the base and the second ring, and these three pieces can be produced using the same mold. Therefore, respectively using different plastic materials for making the first ring and the second ring can produce various light-emitting fans having different lighting effects. For examples, the first ring may be made of light-permeable plastic while the base and the second ring are made of light-impermeable plastic; alternatively, the first ring may be made of light-impermeable plastic while the second ring is made of light-permeable plastic. The former case can obtain a light-emitting fan only having its impeller and inner side of fan frame capable of light-emitting, and the latter case can obtain a light-emitting fan only having its top side of fan frame capable of light-emitting. As discussed, due to the configuration of the light-emitting fan, one specific mold can be used to make various light-emitting fans of different lighting effects. Accordingly, the mold development cost for making light-emitting fans of different lighting effects is reduced.

Note that, in some embodiment, both of the first ring and the second ring may be made of light-permeable plastic, where the first ring and the second ring are made of different plastics having different tranmittances. This arrangement can create various combinations of light-emitting effect as well, such as the first and second rings may emit light in different brightnesses.

According to the light-emitting fan discussed above, the fan frame is assembled from the base, the first ring, and the second ring, and the first ring is located between the base and the second ring. By choosing the plastic materials of making the first ring and the second ring, the light-emitting fans in different lighting effects can be made by the same mold. As such, the cost of mold development can be saved.

The embodiments are chosen and described in order to best explain the principles of the present disclosure and its practical applications, to thereby enable others skilled in the art best utilize the present disclosure and various embodiments with various modifications as are suited to the particular use being contemplated. It is intended that the scope of the present disclosure is defined by the following claims and their equivalents.

What is claimed is:

1. A light-emitting fan, comprising:

a fan frame, comprising:

a base;

a first ring, disposed on the base, wherein the first ring comprises a first outer part; and a second ring, disposed on the first ring, wherein the first ring is located between the base and the second ring, and the first ring and the second ring together form an accommodating space;

an impeller, located in the accommodating space, surrounded by the first ring and the second ring and rotatably disposed on the base;

a light-emitting component, located in the first ring or the second ring;

a plurality of fasteners and a plurality of cushions, wherein the first ring further comprises a plurality of protrusions connected to different sides of the first outer part, and the plurality of cushions are disposed to the plurality of protrusions via the plurality of fasteners configured to be engaged with the plurality of protrusions; and wherein one of the first ring and the second ring is made of light-permeable plastic, another one of the first ring and the second ring is made of light-impermeable plastic, and light from the light-emitting component is emitted through the first ring or the second ring.

2. The light-emitting fan according to claim 1, wherein the first ring is made of light-permeable plastic, the second ring is made of light-impermeable plastic, and light from the light-emitting component is emitted through the first ring.

3. The light-emitting fan according to claim 2, wherein the first ring further comprises a first inner part, and a first connection part, the first inner part and the first outer part form a first annular groove therebetween, the first connection part is connected to the first inner part and the first outer part and covers a side of the first annular groove, the first inner part and the first outer part are disposed on the base, the light-emitting component is located in the first annular groove, and the second ring is disposed on the first connection part.

4. The light-emitting fan according to claim 3, wherein the light-emitting component comprises a ring-shaped substrate and a plurality of light sources, the ring-shaped substrate is located in the first annular groove, and the plurality of light sources are disposed on a side of the ring-shaped substrate facing the first inner part of the first ring so as to emit light towards the first inner part.

5. The light-emitting fan according to claim 3, wherein the second ring comprises a second inner part, a second outer part, a second connection part, and a plurality of reinforcing ribs, the second inner part and the second outer part form a second annular groove therebetween, the second connection part is connected to the second inner part and the second outer part and covers a side of the second annular groove, and the plurality of reinforcing ribs are located in the second annular groove and disposed on the first connection part.

6. The light-emitting fan according to claim 5, wherein the base comprises a plurality of first engagement components, the first outer part of the first ring comprises a plurality of second engagement components, the second outer part of the second ring comprises a plurality of third engagement components, the plurality of first engagement components are respectively detachably engaged with the plurality of second engagement components, the plurality of third engagement components are respectively detachably engaged with the plurality of second engagement components, and the plurality of first engagement components and the plurality of third engagement components are located at different sides of the plurality of second engagement components.

7. The light-emitting fan according to claim 3, wherein the impeller comprises a hub and a plurality of blades, the hub is rotatably disposed on the base, the plurality of blades are connected to the hub, the hub has a top surface and a bottom surface opposite to each other, the bottom surface is located closer to the base than the top surface, and the first ring is located between a plane where the top surface is located and a plane where the bottom surface is located.

8. The light-emitting fan according to claim 1, wherein the first ring is made of light-impermeable plastic, the second ring is made of light-permeable plastic, and light from the light-emitting component is emitted through the second ring.

9. The light-emitting fan according to claim 8, wherein the first ring further comprises a first inner part, and a first connection part, the first inner part and the first outer part form a first annular groove therebetween, the first connection part is connected to the first inner part and the first outer part and covers a side of the first annular groove, the first connection part has a plurality of holes, the first connection part is disposed on the base, the second ring is disposed on the first inner part and the first outer part, the light-emitting component is located in the first annular groove so as to emit light through the plurality of holes.

10. The light-emitting fan according to claim 9, further comprising at least one light guide, wherein the second ring comprises a second inner part, a second outer part, and a second connection part, the second inner part and the second outer part form a second annular groove therebetween, the second connection part is connected to the second inner part and the second outer part and covers a side of the second annular groove, the second inner part and the second outer part are disposed on the first connection part, the second annular groove and the first annular groove are connected via the plurality of holes, the at least one light guide is located in the second annular groove and at a side of the impeller so as to guide light generated by the light-emitting component towards the second connection part of the second ring.

11. The light-emitting fan according to claim 10, wherein a quantity of the at least one light guide is plural, and the light guides are respectively located at opposite sides of the impeller.

12. The light-emitting fan according to claim 9, wherein the light-emitting component comprises a ring-shaped substrate and a plurality of light sources, the ring-shaped substrate is located in the first annular groove, and the plurality of light sources are disposed on a side of the ring-shaped substrate facing the first inner part of the first ring.

13. The light-emitting fan according to claim 12, further comprising an annular light guide, wherein the second ring comprises a second inner part, a second outer part, and a second connection part, the second inner part and the second outer part form a second annular groove therebetween, the second connection part is connected to the second inner part and the second outer part and covers a side of the second annular groove, the second inner part and the second outer part are disposed on the first connection part, the second annular groove and the first annular groove are connected via the plurality of holes, the annular light guide is located in the second annular groove so as to guide light generated by the light-emitting component towards the second connection part of the second ring.

14. The light-emitting fan according to claim 9, wherein the base comprises a plurality of first engagement components, the first outer part of the first ring comprises a plurality of second engagement components, a second outer part of the second ring comprises a plurality of third engagement components, the plurality of first engagement components are respectively detachably engaged with the plurality of second engagement components, the plurality of third engagement components are respectively detachably engaged with the plurality of second engagement components, and the plurality of first engagement components and the plurality of third engagement components are located at different sides of the plurality of second engagement components.

15. The light-emitting fan according to claim 9, wherein the impeller comprises a hub and a plurality of blades, the hub is rotatably disposed on the base, the plurality of blades are connected to the hub, the hub has a top surface and a bottom surface opposite to each other, the bottom surface is located closer to the base than the top surface, and the second ring is located at a side of a plane where the top surface is located away from the base.

* * * * *